US007937910B2

(12) United States Patent
Jaconelli et al.

(10) Patent No.: US 7,937,910 B2
(45) Date of Patent: May 10, 2011

(54) METHOD AND MACHINE FOR PREPARING AND DEPOSITING A STRETCH-FILM PACKAGING SLEEVE ON A PALLETIZED LOAD

(75) Inventors: Jean-Christophe Jaconelli, Méry (FR); Benoît Pottier, Méry (FR)

(73) Assignee: Thimon, Mery (FR)

( * ) Notice: Subject to any disclaimer, the term of this patent is extended or adjusted under 35 U.S.C. 154(b) by 350 days.

(21) Appl. No.: 12/084,202

(22) PCT Filed: Nov. 9, 2006

(86) PCT No.: PCT/FR2006/002502

§ 371 (c)(1),
(2), (4) Date: May 27, 2008

(87) PCT Pub. No.: WO2007/054647

PCT Pub. Date: May 18, 2007

(65) Prior Publication Data

US 2010/0162660 A1 Jul. 1, 2010

(30) Foreign Application Priority Data

Nov. 10, 2005 (FR) ..... 05 11478

(51) Int. Cl.
*B65B 53/00* (2006.01)

(52) U.S. Cl. ..... 53/441; 53/459; 53/556; 53/567

(58) Field of Classification Search ..... 53/441, 53/556, 582, 459, 567, 568
See application file for complete search history.

(56) References Cited

U.S. PATENT DOCUMENTS

| | | | | |
|---|---|---|---|---|
| 3,961,459 | A | 6/1976 | Wolske | |
| 4,454,705 | A | 6/1984 | Benno | |
| 4,499,706 | A * | 2/1985 | Scheller | 53/399 |
| 4,546,598 | A * | 10/1985 | Karpisek | 53/556 |
| 6,751,931 | B2 * | 6/2004 | Cere' | 53/397 |
| 6,845,600 | B2 * | 1/2005 | Hannen et al. | 53/459 |
| 6,978,587 | B2 * | 12/2005 | Drolet | 53/556 |
| 7,334,384 | B2 * | 2/2008 | Nissen | 53/459 |
| 2004/0107677 | A1 | 6/2004 | Hannen et al. | |

FOREIGN PATENT DOCUMENTS

| | | |
|---|---|---|
| DE | 100 21 157 A1 | 10/2001 |
| DE | 101 62 482 A1 | 11/2003 |
| EP | 1 060 988 A1 | 12/2000 |
| EP | 1 106 507 A1 | 6/2001 |

* cited by examiner

*Primary Examiner* — Paul R Durand
(74) *Attorney, Agent, or Firm* — Oliff & Berridge, PLC

(57) ABSTRACT

A packaging machine comprises a preparation station for preparing a sleeve from a stretchable plastic film wound flat around a storage reel, and a gripper device for taking hold of the sleeve and transferring it to the depositing station for enveloping the load. According to the invention, the gripper device comprises at least one set of grippers which is equipped with notched bars to create differential stretch with the formulation of a lunula. Each bar is given a translational and/or rotational movement so that the bar can be extracted and the sleeve disengaged at the end of the depositing cycle.

19 Claims, 10 Drawing Sheets

METHOD AND MACHINE FOR PREPARING AND DEPOSITING A STRETCH-FILM PACKAGING SLEEVE ON A PALLETIZED LOAD

BACKGROUND OF THE INVENTION

The invention relates to a method and a machine for preparing and depositing a packaging sleeve or strip on a palletized load, and consisting in:

- forming the sleeve in a preparation station from a flexible plastic film wound flat on at least one storage reel,
- taking hold of the sleeve by means of a gripper device equipped with at least one set of grippers movable in the heightwise direction with a vertical translation movement between a raised position and a lowered position,
- performing transverse stretching in the raised position by moving the four corners of the sleeve apart by means of the set of grippers,
- after stretching, transferring the sleeve to a position above the load situated in a depositing station, the overstretching perimeter then being greater than the pick-up perimeter,
- and lowering the sleeve to envelop the load to be packaged.

STATE OF THE ART

Overpackaging a palletized load by means of a plastic cover is performed in conventional manner from a film or a sleeve with or without pleats. Depending on the type of load to be packaged and the type of packaging required, either a heat-shrink film or a stretchable film is used.

In the case of a heat-shrink film, the heat source generally used for shrinking the film onto the load is provided by gas burners arranged on the four corners of a mobile frame designed to move vertically at a small distance along the lateral surface of the load to heat the film. Creation of a lunula is generally achieved by combination of a combined effect of shrinking and blowing or sucking air at the ends of the load. This system is difficult to master when the vertical overshoot of film with respect to the load is large, when the dimensions of the load to be packaged are large or when there is a significant difference between the length and width of the product to be packaged, when the shrinkage parameters are incorrectly adjusted or drift, or when shrinking is disturbed by external phenomena (draughts, wind, ambient temperature variations, etc.). This technique of shrinking the film by heating imposes precise adjustment of the temperature and operating time of the burners. Incorrect adjustment can therefore give rise to damage for the operator, for example fire risks on the products, damage to the packaging in case of overheating, etc.

In the case of a stretchable film, transverse stretching generally takes place after the sleeve has been pleated on stretching fingers. The packaging rates of existing machines remain limited. When a sleeve higher than the load is deposited to create a lunula, the film does not always position itself on the top and bottom faces of the load when the depositing means are withdrawn. The film can in fact be deposited on the vertical faces of the product. Formation of the lunula is not controlled, resulting in risks of random positioning on the load.

The two documents EP 1106507 and U.S. Pat. No. 3,961,459 describe overpackaging machines in which the closed bottom face of the cover or sleeve places itself on the top face of the product to be packaged, the film then being unwound throughout the whole descent of the grippers along the product.

The document U.S. Pat. No. 4,454,705A describes a machine which deposits a sleeve by means of bars which retract by translations, but without forming a lunula on the top and/or bottom face.

OBJECT OF THE INVENTION

A first object of the invention consists in depositing a stretchable plastic film sleeve on a load with formation of at least one lunula on one of the two top or bottom faces to obtain optimum overlapping of the load, and perfect packaging aesthetics without resorting to heat sources for shrinking the film.

The packaging method according to the invention consists in using grippers in the form of bars equipped with a notch at least at one of the ends thereof to apply a reduced stretching ratio at the level of the notch so as to create a lunula on the top and/or bottom face after the set of grippers has been disengaged and the sleeve has been deposited on the load.

The method of applying the sleeve onto the load does not use a heat source of the gas burner type for shrinking the film, but only the elastic relaxation properties of the film used. The elasticity characteristics of the film can be modified, in particular during a pre-stretching phase before formation of the sleeve.

Differential stretching is performed without prior pleating of the sleeve, enabling production rates to be increased. The presence of the lunulas on the top and bottom faces enables the ends of the packaged load to be covered regularly. The presence of a lunula at the bottom part enhances securing of the sleeve on the load during disengagement of the gripper bars. The size of the top or bottom lunula may vary according to the height of the cutout sleeve compared with the height of the product to be packaged. The bottom lunula should therefore be dimensioned so as to guarantee securing of the sleeve on the product when the bars are withdrawn.

The use of two sets of grippers enables the latter to be either synchronized raising them two by two on one and the same gripper arm, or to be desynchronized raising them individually on two independent arms.

The throughput rates can in fact be increased by using a gripper device comprising two synchronized sets of grippers. The handling arm is rotated through a half-turn in the raised position to position the stretched sleeve above the load in the depositing station, and to simultaneously move the empty second set of grippers back to the preparation station, and the handling arm is then moved to the lowered position to perform placing of the stretched sleeve on the load in the depositing station, and to pick up the next sleeve simultaneously formed in the preparation station, respectively by means of the first set of grippers and the second set of grippers. When the handling arm is raised to the raised position, the two sets of grippers move up simultaneously causing the grippers to be disengaged from the packaged load, and from the preparation station before the rotational movement of said arm.

The invention takes account of different formation techniques of the sleeve in the preparation station from reels of film of various cross-sections:

- either by means of a tubular cover with pleats,
- or by means of a tubular cover without pleats,
- or by means of a width of film unwound directly or in a spiral according to the required length of sleeve.

The cover is cut according to the height of the load so as to present two open ends.

A second object of the invention consists in providing a machine for preparation and deposition of a stretchable plastic film sleeve on a load, enabling formation of at least one lunula and stable and aesthetic packaging of the load.

The machine comprises a preparation station of a sleeve from a flexible plastic film wound flat around a storage reel, and a gripper device to take hold of the sleeve and transfer it to the deposition station to envelop the load. According to the invention, each bar has a notch at least at one of the ends thereof to obtain a differential stretching ratio allowing formation of a lunula on the top and/or bottom surface of the load.

Preferably, each bar rotates by a predetermined angle at the end of deposition travel and then moves in translation to the middle part of a lateral face of the load to allow vertical disengagement thereof in the upwards direction. The sleeve is thus easily released without impairing the packaging quality.

According to an alternative embodiment, the bars can have rounded cross-sections to deposit the sleeve and to then disengage. Following a vertical disengagement of the round bars without rotation, a top lunula can be obtained. Formation of a bottom lunula is performed by letting the film overflow under the bars and by stretching the sleeve more when deposition is performed.

According to a preferred embodiment, the gripper device comprises two sets of grippers movable in the heightwise direction between a raised position and a lowered position, and control means to, in the raised position, position said stretched sleeve above the load by means of the first set of grippers, while at the same time moving the empty second set of grippers back to the preparation station, and at the same time, in the lowered position, to perform placing of the stretched sleeve on the load in the depositing station, respectively by means of the first and second set of grippers.

Such a machine with two working stations one of which operates in masked time enables high packaging rates to be achieved, given that preparation of the sleeves is performed during deposition on the loads. The control means control the whole system to ensure synchronization of the displacement movements of the handling arm and of the sets of grippers. The movements of the two sets of grippers can be simultaneous being mechanically linked to one another, or be independent.

Different sleeve preparation stations can equip the machine according to the type of packaging cover used.

The depositing station can be equipped with an additional securing system of the load to be packaged designed to oppose any friction effect of the bars on the film which would pull the load upwards when vertical removal of the bars takes place.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF A PARTICULAR EMBODIMENT

Figure 1:
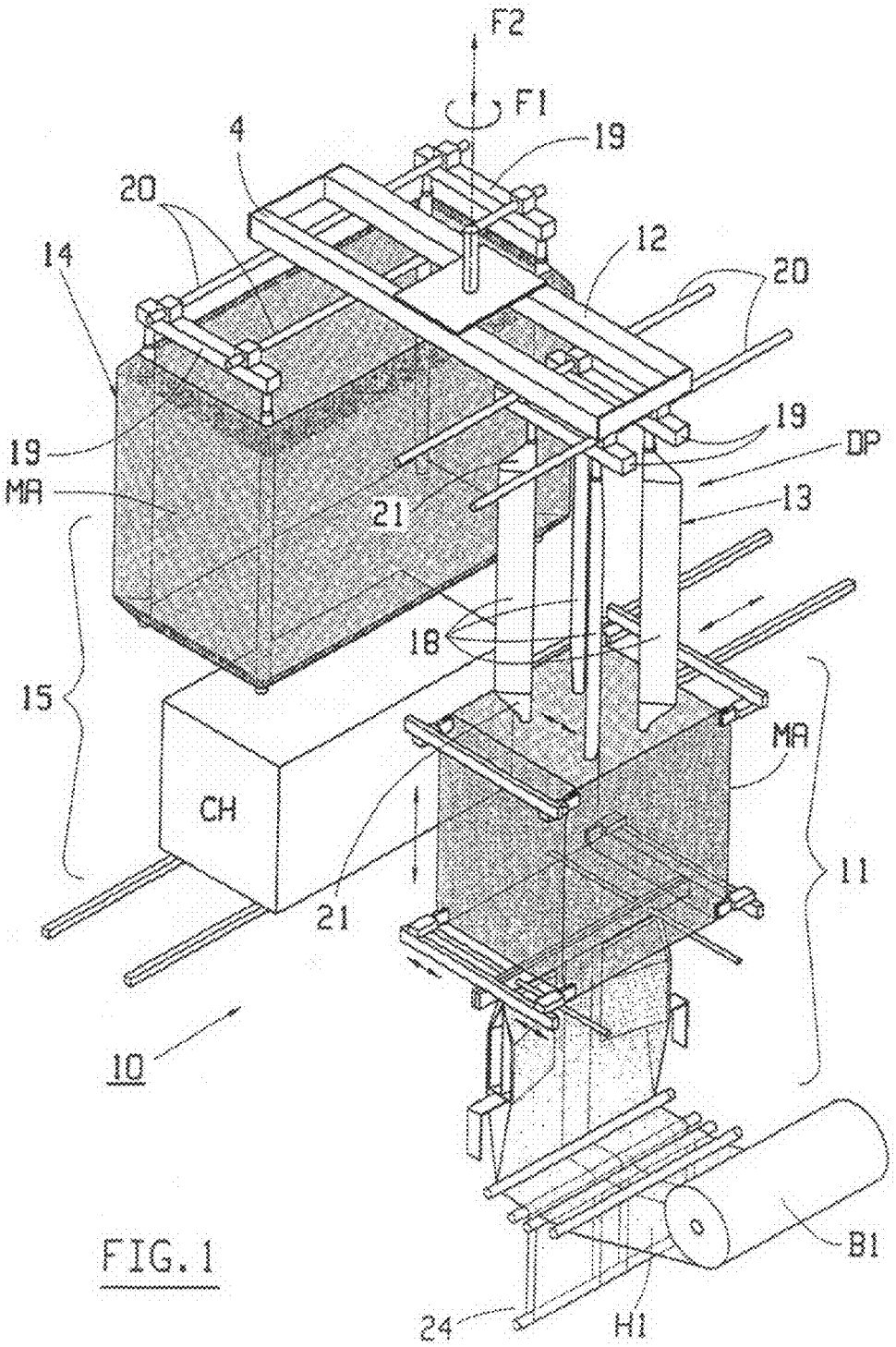
FIG. 1 is a schematic perspective view of the packaging machine according to the invention, the handling arm with the two sets of grippers being represented in the raised position.

With reference to FIG. 1, the packaging machine 10 according to the invention is composed of a preparation station 11 of a sleeve MA or strip of stretchable plastic film, of a rotary handling arm 12 equipped with a gripper device DP equipped with two sets of grippers 13, 14, and a depositing station 15 for depositing sleeve MA on load CH.

Such a packaging machine with two workstations, one of which works in masked time, enables high throughput rates to be obtained, given that preparation of sleeves MA in station 11 takes place during the deposition operation of previous sleeve MA on a load CH located in the other station 15.

Packaging sleeve MA is formed from a stretchable plastic film, in particular described in the document EP-A-1060988. Sleeve MA, once it has been formed, undergoes a first stretching operation before deposition, followed by a second flexible relaxation operation on load CH at the end of deposition. Load CH presents a parallelepipedic shape.

Figure 3:
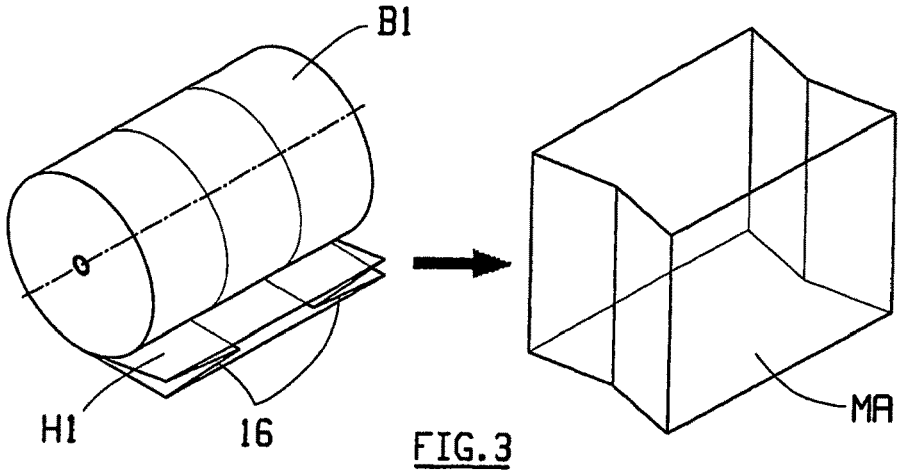
FIGS. 3 to 5 show different types of film for formation of the sleeve.

Formation of sleeve MA with open opposite ends is performed in preparation station 11 in three different manners:

- either by means of a tubular cover H1 with folded pleats 16, the cover being wound flat (FIG. 3) around a reel B1;
- or by means of a tubular cover H2 without pleats 16, also wound flat (FIG. 4) around a reel B2;
- or by means of a width H3 of film wound flat around a reel B3 and unwound directly or in a spiral according to the required length of sleeve and the width of film used. At least one vertical weld 17 is then made along the two ends to form sleeve MA (FIG. 5).

Sleeve MA, regardless of its production method, is then picked up in preparation station 11 by gripper device DP by means of a first separation movement of bars 18, and is pulled upwards by a vertical movement to disengage it from preparation station 11 to perform overstretching thereof.

Gripper device DP comprises two sets of grippers 13, 14 of identical structure, each set being equipped with four vertical bars 18 mounted movable in translation two by two on two horizontal and parallel beams 19. The two beams 19 are themselves mounted movable in translation on rods 20 parallel to a frame, which rods extend orthogonally with respect to beams 19. Bars 18 of each gripper set 13, 14 are thereby animated with two perpendicular translational movements enabling sleeve MA to be given a perimeter suitable for deposition on load CH.

Each bar 18 can in certain cases be animated with a limited rotational movement around its vertical axis to enable sleeve MA to be disengaged at the end of cycle.

Actuation of bars 18 for disengagement of sleeve MA can be performed by any other control mechanism.

Figure 2:
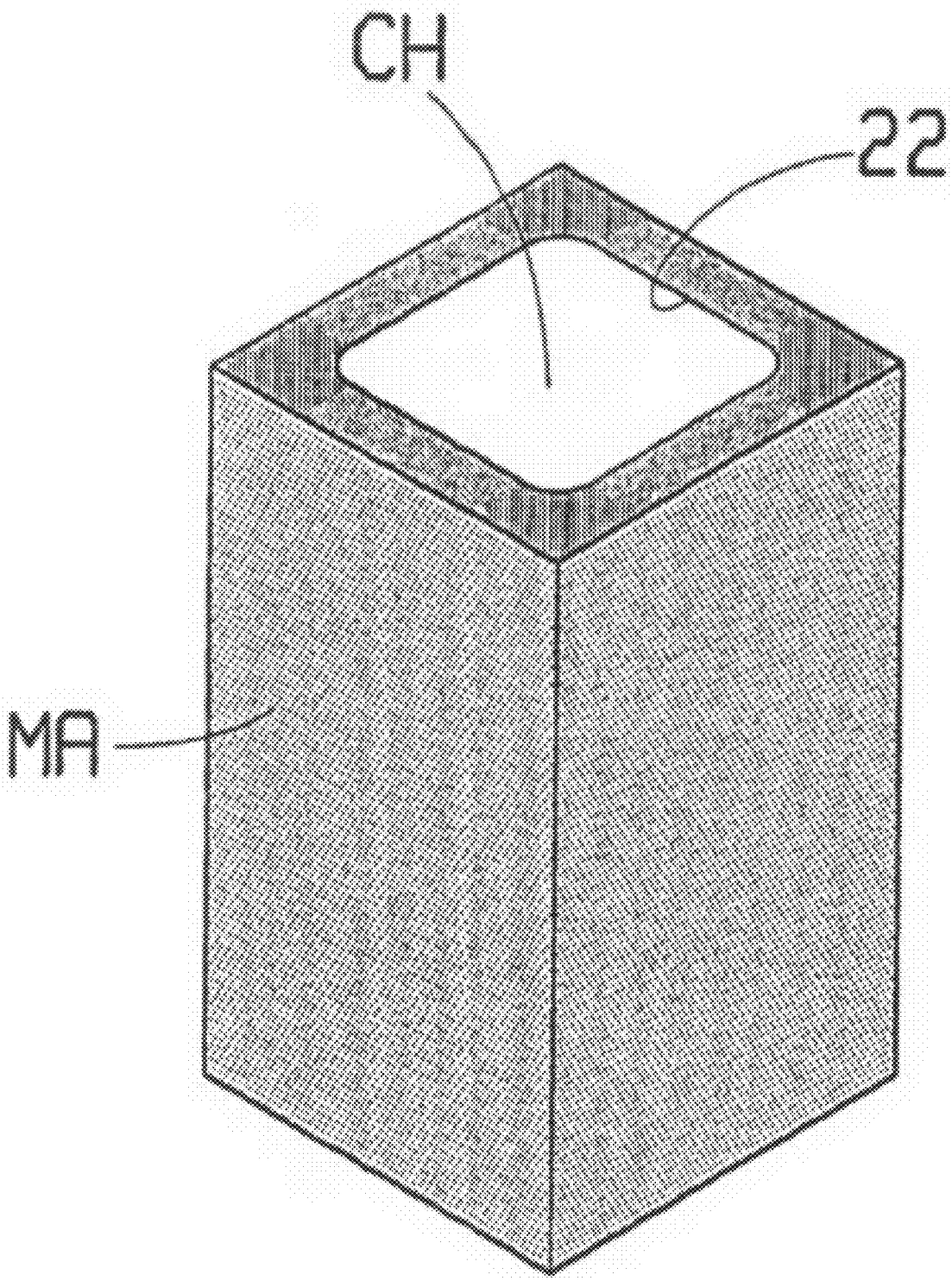
FIG. 2 illustrates perspective views of the load covered by the packaging sleeve with lunula.

The profile of bars 18 varies according to the type of packaging to be performed, with the presence of lunulas (FIG. 2) on the top and bottom faces of load CH to be packaged.

Figure 6:
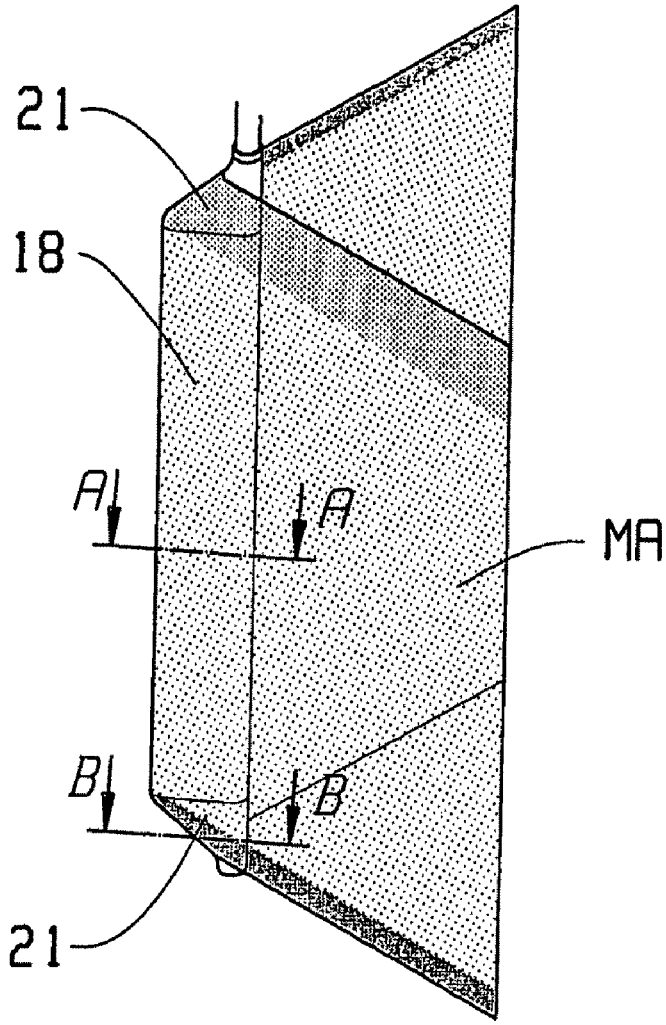
FIG. 6 is a view of a notched gripping bar enabling formation of a sleeve with lunulas by differential stretching.
Figure 7:
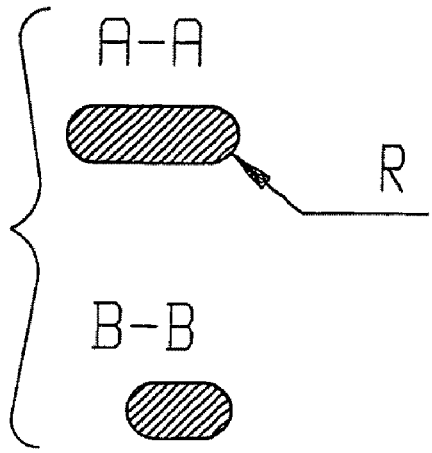
FIG. 7 shows cross-sectional view along the lines A-A and B-B of FIG. 6.

To constitute a sleeve MA with lunulas (FIG. 2), each vertical bar 18 of the two sets of grippers 13, 14 has a notch 21 at each end so as to apply a reduced stretching ratio at the ends of sleeve MA (see FIG. 6). This results in a differential stretching ratio of the film according to the height.

The length of bars 18 can be adjusted according to the required length of sleeve MA.

Handling arm 12 bears the two sets of grippers 13, 14 and is mounted on the main frame (not shown). According to one embodiment, arm 12 can be animated with a first rotational movement (arrow F1, FIG. 1) enabling the movements of the two sets of grippers 13, 14 to be synchronized between the two stations 11, 15, and with a second vertical rotational movement (arrow F2) enabling all the bars 18 to be disengaged from the packaged load CH, and from the preparation station 11 before rotation. Rotary handling arm 12 is thereby movable in the heightwise direction between a raised position and a lowered position.

Implementation of Sleeve MA on Load CH is Performed in the Following Manner:

Once sleeve MA has been formed, the four bars 18 of gripper set 13 situated above preparation station 11 come and pick up sleeve MA and pull it up to the raised position following the upward vertical movement of handling arm 12 (arrow F2).

In the case of FIGS. 1 to 7, bars 18 with notches 21 form lunulas 22 at the top and bottom of sleeve MA (FIG. 2) by differential stretching according to the height. Each bar 18 has a rounded profile of preset radius R so as to reduce the mechanical stresses of the film when transverse stretching takes place.

After sleeve MA has been disengaged from preparation station 11, the four bars 18 of the first gripper set 13 stretch sleeve MA transversely at the four corners (FIG. 8A) to increase the perimeter thereof due to the elasticity of the film. The overstretching perimeter p2 is therefore larger than the pick-up perimeter p1 of sleeve MA.

At no time is sleeve MA pleated when transfer thereof is performed from preparation station 1, and during differential stretching.

Then, during or at the end of the stretching phase, handling arm 12 performs a rotational movement through 180° (arrow F1, FIG. 1) to position stretched sleeve MA above load CH of depositing station 15, and to simultaneously return the empty second gripper set 14 to preparation station 11.

Figures 8A, 8B:
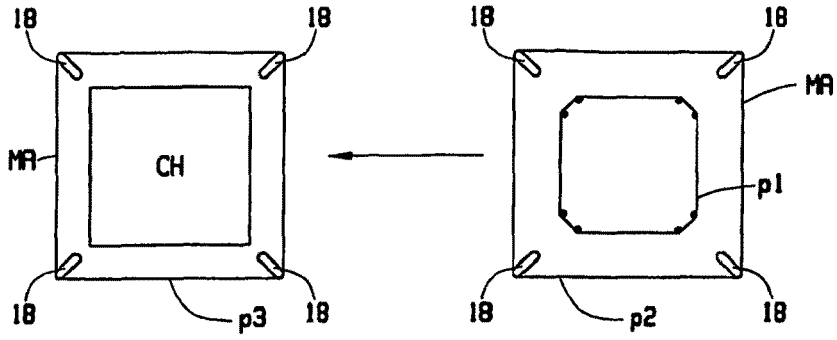
FIGS. 8A and 8B are schematic plan views of the sleeve, respectively during transverse stretching thereof by the bars of one of the sets of grippers and during transfer thereof above the load following rotation of the handling arm through a half-turn.

At the end of rotation of handling arm 12, the four bars 18 of first gripper set 13 adjust their position above load CH to obtain an optimum sleeve perimeter p3 for deposition (see FIG. 8B). Handling arm 12 then starts its descent to perform the two operations of fitting sleeve MA on load CH in depositing station 15 and picking up next sleeve MA formed in preparation station 11.

Figure 9A:
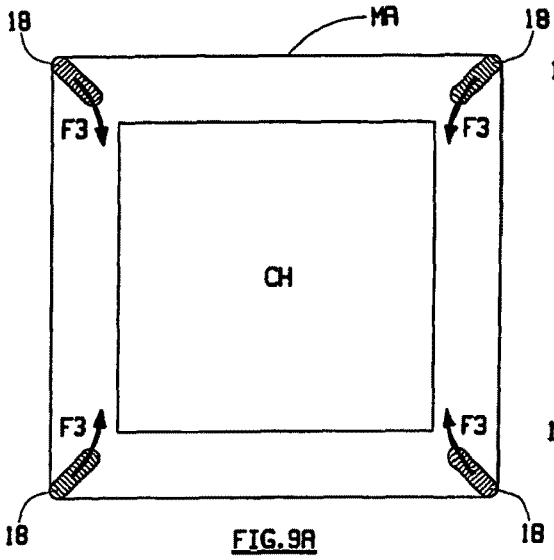
FIGS. 9*a* to 9*d* illustrate the different phases of disengagement of the gripping bars when a sleeve with lunulas is deposited on the load.
Figure 9B:
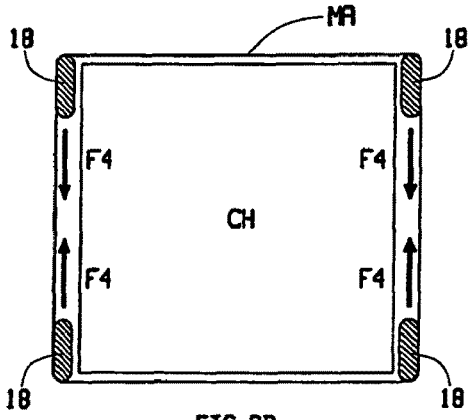
Figure 9C:
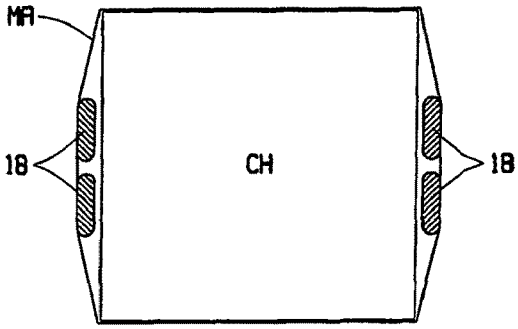

In the lowered position of arm 12 corresponding to downward travel of first gripper set 13, bars 18 rotate through more or less 45° (arrows F3, FIG. 9A), and then translate horizontally two by two towards one another along load CH (arrow F4, FIGS. 9B and 9C).

This results in flat cross-section bars 18 remaining parallel to two opposite lateral sides of load CH to minimize deformation of sleeve MA in the elongation direction of its perimeter.

Figure 9D:
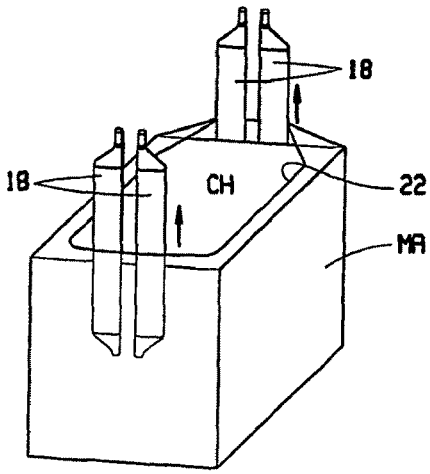

In FIGS. 9C and 9D, bars 18 of first set 13 are moved towards the centre of the lateral sides of load CH in depositing station 15, whereas the next sleeve is picked up in preparation station 11 by bars 18 of second set 14. Handling arm 12 moves upwards to release load CH and at the same time to move the next sleeve out from preparation station 11. Load CH enveloped by packaging sleeve MA is removed by a conveyor and a new load to be packaged is transferred to depositing station 15.

According to an alternative embodiment, extraction of notched bars 18 can also take place by means of two translational movements, in particular a lateral movement to release the corners and a vertical extraction movement.

Figure 10:
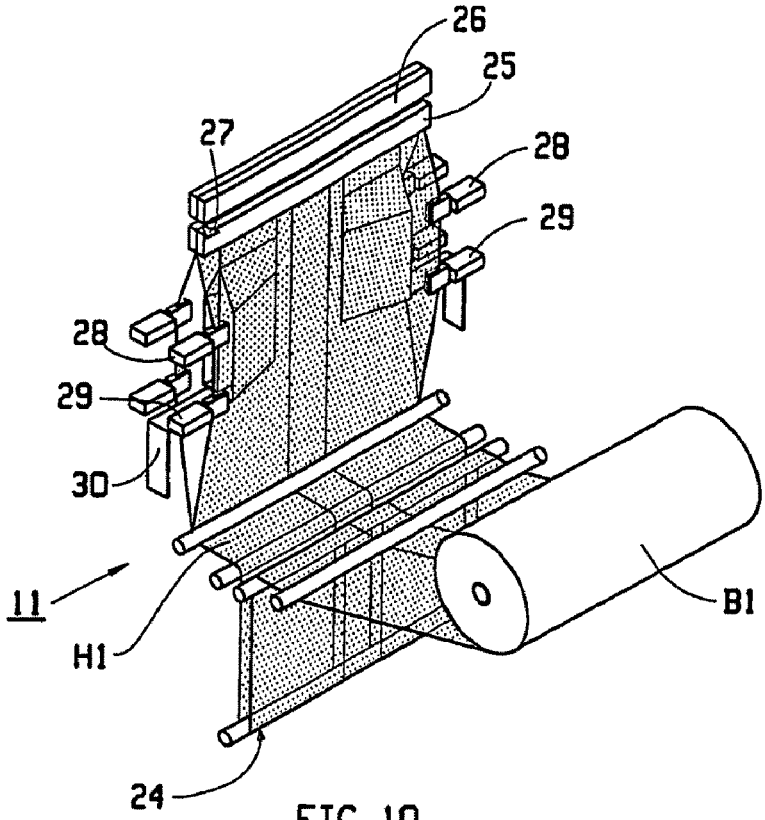
FIG. 10 is a detailed view of the preparation station used in the machine of FIG. 1, with the closed sleeve achieved from a tubular cover with pleats.

In FIG. 10, preparation station 11 of sleeve MA corresponds to that of packaging machine 10 illustrated in FIG. 1. It comprises a horizontally positioned winding reel B1 and an accumulation circuit 24 for storing film when sleeve MA is formed. It is clear that reel B1 can be arranged vertically or with any angle with respect to the horizontal, being associated with an angle transmission, for example at 90°.

The film used is a tubular cover H1 with pleats 16 (FIG. 3), the end whereof is secured by a pair of clamping jaws 25, 26 situated on each side of blade cutting device 27. At the beginning of the preparation cycle of sleeve MA, only clamping jaw 25 is in the closed position.

To trigger the preparation cycle of sleeve MA, station 11 comprises two sets of four grips 28, 29 that move to a position at the top of sleeve MA and underneath lower clamping jaw 25. Sleeve MA is opened by means of two separators 30, and clamping jaws 25, 26 open after cover H1 has been picked up by grips 28 of the first set. The latter pull cover H1 up to a predetermined height which depends on the length of sleeve MA. In this position, grips 29 of the second set position themselves just above the upper clamping jaw 26, and close to pick up cover H1 at its four corners.

After clamping jaws 25, 26 have closed, blade cutting device 27 cuts thus prepared sleeve MA to the required length. Upper clamping jaw 26 opens, and set of grips 28, 29 open sleeve MA at pick-up perimeter p1 (FIG. 8A).

The four bars 18 of one of the sets of grippers 13, 14 then enter inside sleeve MA positioning grips 28, 29 at the level of notches 21. Opening of the two sets of grips 28, 29 releases sleeve MA, which is held by the four gripping bars 18. Grips 28, 29 are moved apart laterally, and are then moved to the lowered position underneath bottom clamping jaw 25. Grips 28, 29 are inserted in pleats 17 of the next sleeve.

Figure 4:
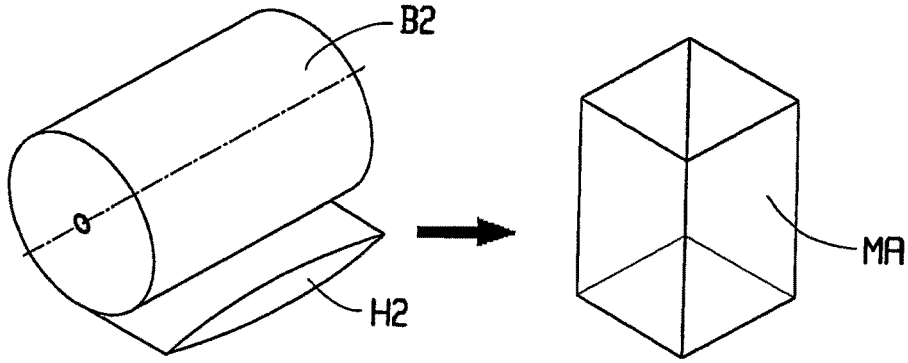
Figure 5:
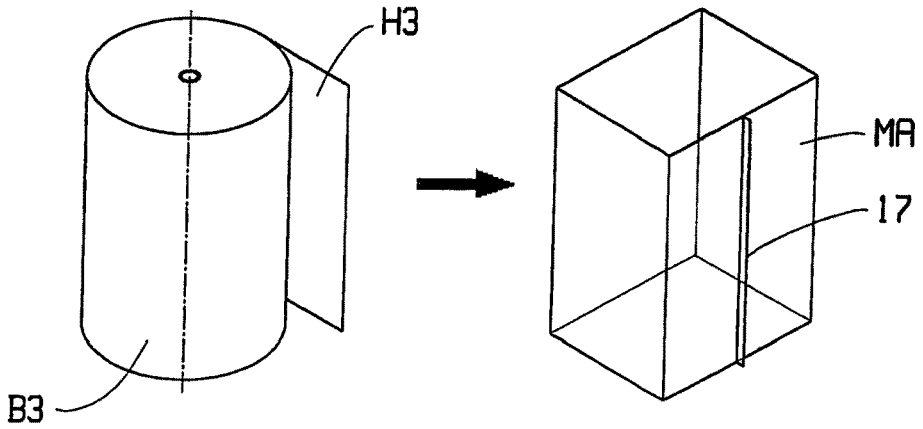
Figure 11:
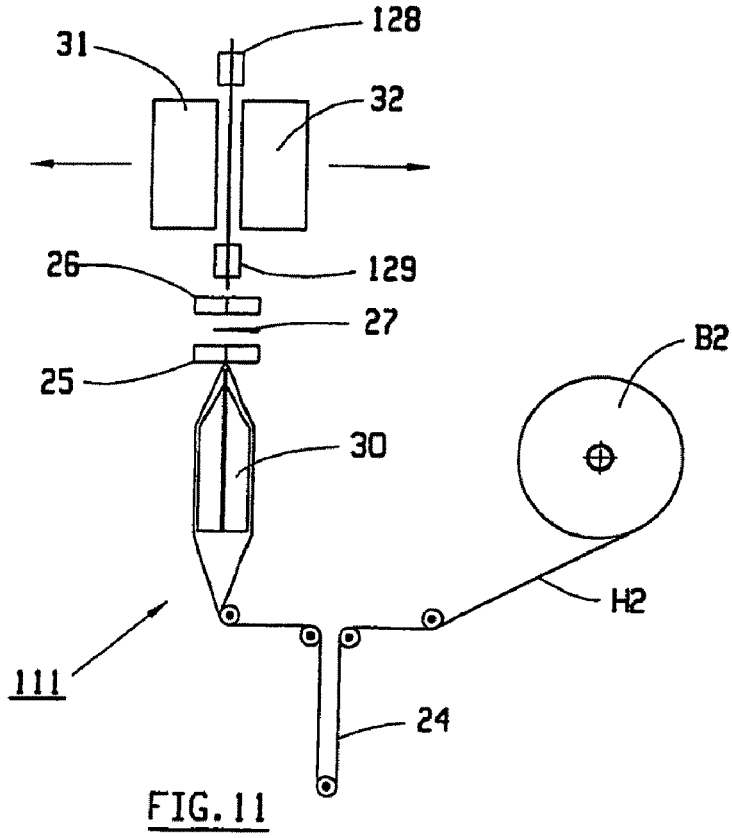
FIGS. 11 and 12 show two alternative embodiments of the preparation station.

With reference to FIG. 11, preparation station 11 is provided for formation of sleeve MA of FIG. 4 using tubular cover H2 without pleats. The preparation principle is similar to that described above, with the exception of opening of the sleeve. The sets of grips 128, 129 only comprise two grips each, which grips have to pick up the two widths together. Opening of sleeve MA is performed by two suction boxes 31, 32 creating a negative pressure. The boxes can be equipped with mechanical grippers for ease of opening of the cover.

Figure 12:
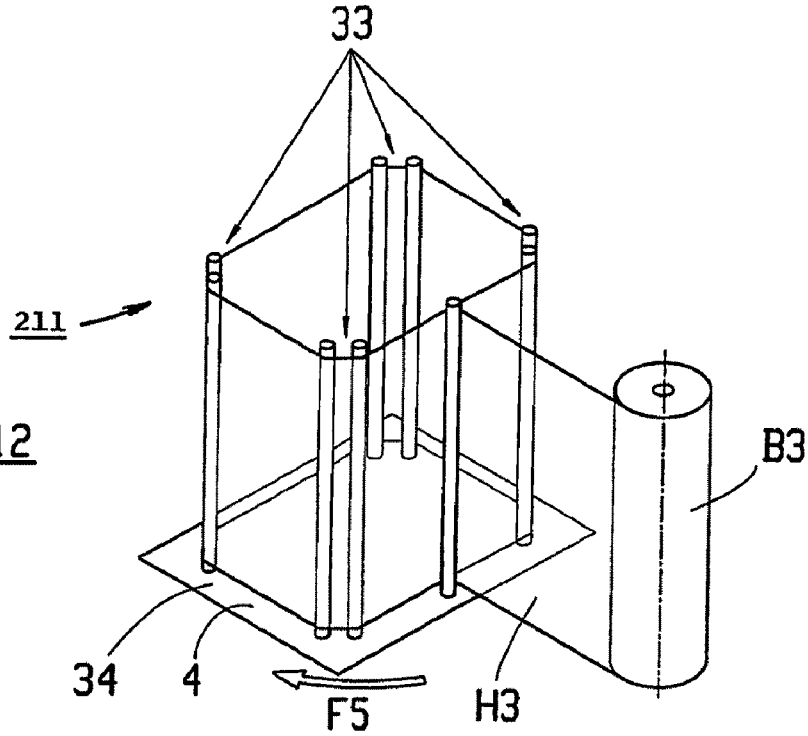
Figure 12A:
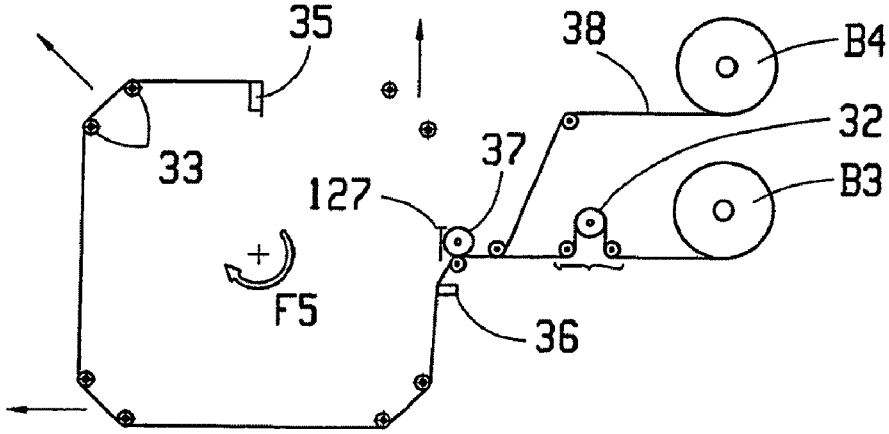
FIGS. 12*a* and 12*b* are schematic plan views of FIG. 12 in the course of winding of the film on the reels.
Figure 12B:
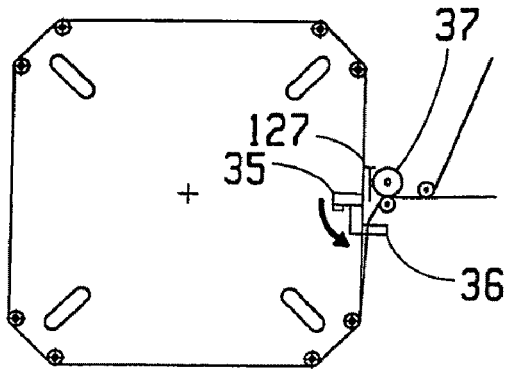

In FIGS. 12, 12*a* and 12*b*, preparation station 211 is provided for formation of sleeve MA of FIG. 5 using a with of film wound flat on a reel B3 and unwound spirally or not depending on the required length of sleeve MA. The film can be pre-stretched by means of a pre-stretching device, and is then unwound by running around four sets of two rollers 33 mounted rotating freely on a rotating plate 34.

The end of the film is secured at the beginning of the cycle by a securing grip 35 integral to plate 34. Plate 34 rotates around its vertical axis (arrow F5) so as to wind the pre-stretched film around the four sets of two rollers 33. At the end of the winding phase, securing grip 35 has reverted to its original position, and pivots through 90° to enable welding means 36 to weld the film. After welding, the film is cut by means of a cutting device 127, and grip 35 is then opened.

Gripper bars 18 then come and take hold of sleeve MA thus formed and pull it vertically upwards after having slightly stretched the sleeve to unstuck it from rollers 33. A motor roller 37 delivers a certain length of film so that the end reaches the level of securing grip 35.

An additional width 38 coming from a second reel B4 (FIG. 12*a*) can be associated with the main width when winding is performed. For example, an advertising strip can thus be placed behind main sleeve MA and centred heightwise.

According to a development of the invention, a cap (not shown) can be added to the top of load CH being joined to sleeve MA by any means, in particular by heat sealing. The tightness is thereby improved according to the nature of the load.

Depending on the height of the loads to be packaged, two sleeves can be successively fitted at different levels of the load.

In the field of household appliances, the weight of the products to be packaged is around 40 kg. To prevent any risk of packaged load CH being pulled upwards during the extraction phase of bars 18, depositing station 15 can be equipped with an additional securing system SR designed to oppose a possible friction effect of the bars on the film.

Figure 13:
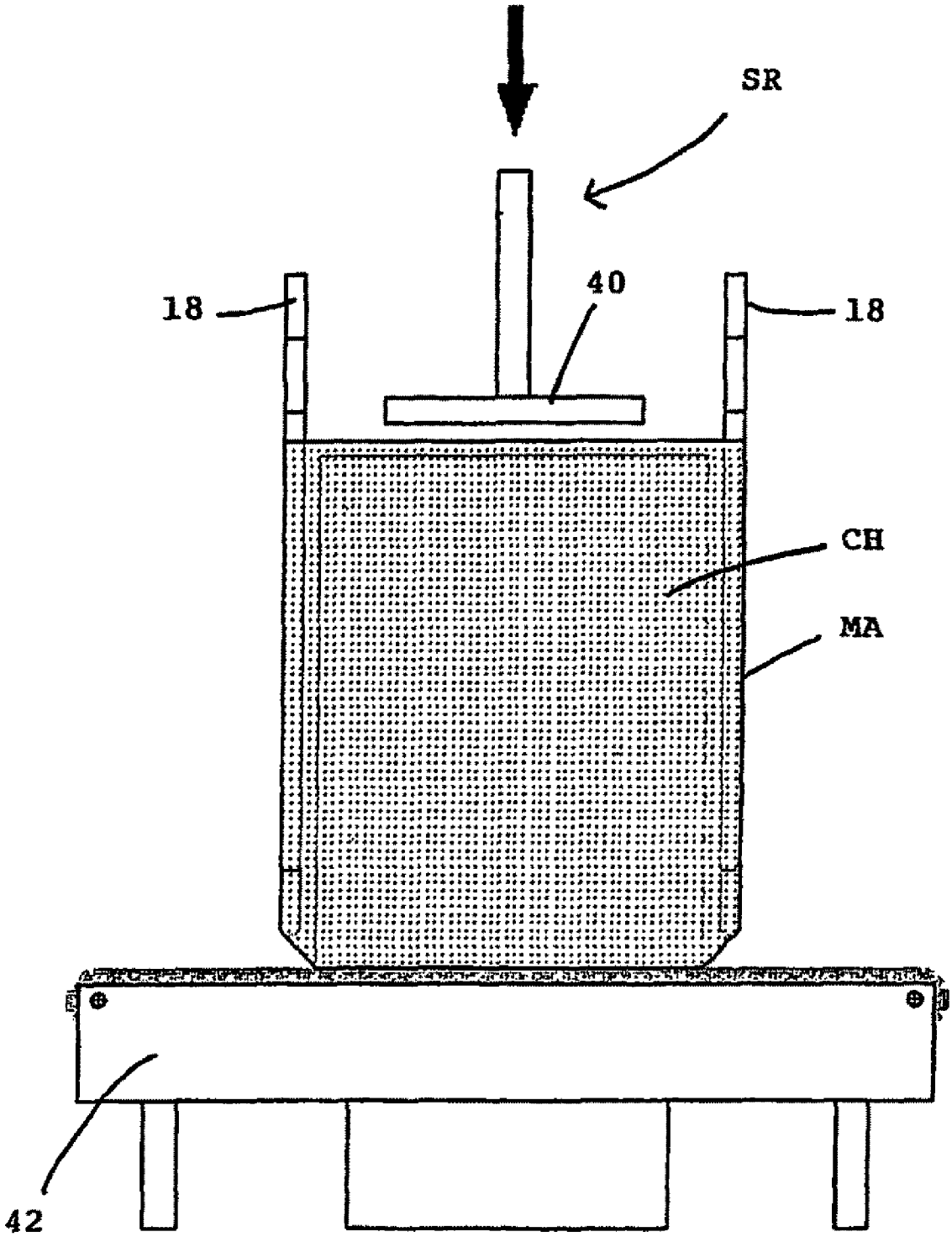
FIGS. 13 to 15 show different embodiments of a securing system designed to oppose a possible friction effect of the bars on the sleeve film during the extraction phase in the depositing station.

In FIG. 13, securing system SR is composed of a presser plate 40 mounted on handling arm 12 between gripper bars 18. Presser plate 40 maintains a pressing force on load CH during the upward movement of arm 12 and bars 18.

Figure 14:
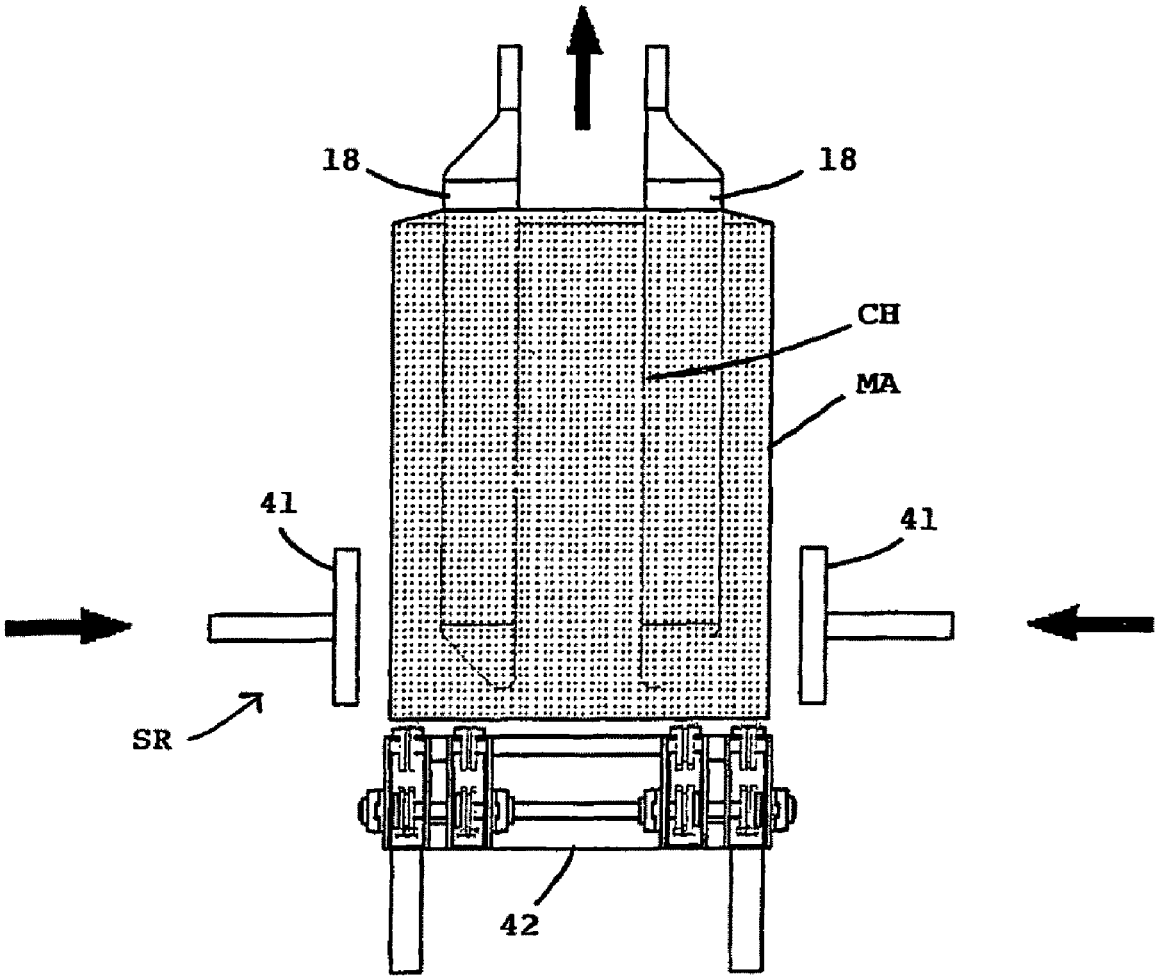

Another embodiment illustrated in FIG. 14 comprises a grip device 41 mounted on the two opposite sides of conveyor 42 to secure load CH at its base after sleeve MA has been deposited and throughout the disengagement phase of bars 18.

Figure 15:
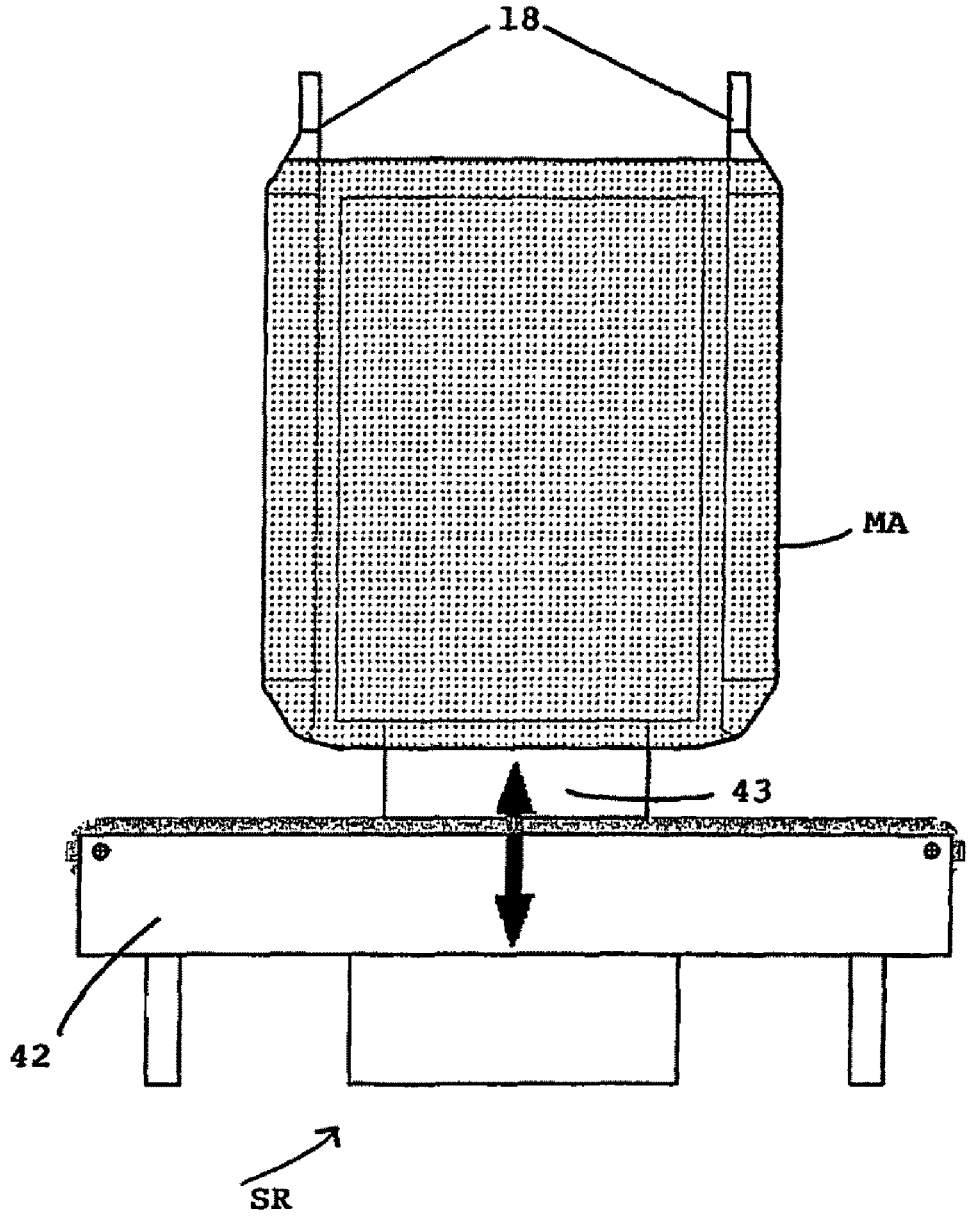

In FIG. 15, a lifting device 43 of load CH facilitates placing of the film of sleeve CH under the bottom face of load CH with formation of a lunula. Lifting device 43 can be integrated in conveyor 42.

The invention claimed is:

1. A method for preparing and depositing a packaging sleeve on a palletized load, comprising:

forming the sleeve in a preparation station from a flexible plastic film wound flat on at least one storage reel, taking hold of the sleeve by means of a gripper device equipped with at least one set of grippers movable in the heightwise direction with a vertical translation movement between a raised position and a lowered position, performing transverse stretching in the raised position by moving the four corners of the sleeve apart by means of the set of grippers, after stretching, transferring the sleeve to a position above the load situated in a depositing station, the overstretching perimeter then being greater than the pick-up perimeter, and lowering the sleeve to envelop the load to be packaged, wherein grippers are used in the form of bars equipped with a notch at least at one of the ends thereof to apply a lower stretching ratio at the level of the notch so as to create a lunula on the top and/or bottom face after the set of grippers has been disengaged and the sleeve has been deposited on the load.

2. The method for preparing and depositing according to claim 1, wherein two synchronized sets of grippers are used, mounted on a rotary handling arm that is movable in translation.

3. The method for preparing and depositing according to claim 2, wherein:

the handling arm is rotated through a half-turn in the raised position to position the stretched sleeve above the load in the depositing station, and to simultaneously move the empty second set of grippers back to the preparation station, and the handling arm is then moved to the lowered position to perform placing of the stretched sleeve on the load in the depositing station, and to pick up the next sleeve simultaneously formed in the preparation station respectively by means of the first set of grippers and the second set of grippers.

4. The method for preparing and depositing according to claim 3, wherein the handling arm is moved from the lowered position to the raised position for simultaneous raising of the two sets of grippers causing disengagement of the grippers from the packaged load, and from the preparation station before rotational movement of said arm.

5. The method for preparing and depositing according to claim 1, wherein two independent sets of grippers are used, mounted respectively on two rotary handling arms that are movable in translation.

6. The method for preparing and depositing according to claim 1, wherein the sleeve is formed by means of a tubular cover with folded pleats which is wound flat around a reel.

7. The method for preparing and depositing according to claim 1, wherein the sleeve is formed by means of a tubular cover without pleats which is wound flat around a reel.

8. The method for preparing and depositing according to claim 1, wherein the sleeve is formed by means of a width of film wound flat around a reel, and unwound with formation of at least one weld at both ends.

9. A machine for preparing and depositing a packaging sleeve on a palletized load, comprising:

a preparation station of a sleeve from a flexible plastic film wound flat around a storage reel, a gripper device to take hold of the sleeve and transfer it to the depositing station to envelop the load, said gripper device comprising at least one set of grippers with movable bars to make the perimeter of the sleeve vary creating transverse stretching, each bar being animated with a translational movement to enable extraction thereof and disengagement of the sleeve at the end of the depositing cycle, wherein each bar has a notch at least at one of the ends thereof to obtain a differential stretching ratio enabling a lunula to be formed on the top and/or bottom surface of the load.

10. The machine according to claim 9, wherein each bar has a round cross-section arranged to obtain a top lunula after disengagement in translation of the bars without rotational movement.

11. The machine according to claim 9, wherein each bar has a round cross-section arranged to obtain a bottom lunula after the film has overflown under the bars and after overstretching of the sleeve when depositing is performed.

12. The machine according to claim 9, wherein each bar rotates through a preset angle at the end of depositing travel and then move in translation to the mid-part of a lateral face of the load to enable vertical disengagement thereof in the upwards direction.

13. The machine according to claim 9, wherein the gripper device comprises two sets of grippers movable in the heightwise direction between a raised position and a lowered position, and control means to, in the raised position, position said sleeve stretched above the load by means of the first set of grippers, while at the same time moving the empty second set of grippers to the preparation station, and at the same time, in the lowered position, to perform fitting of the stretched sleeve on the load in the depositing station, and to pick up the next sleeve formed in the preparation station, respectively by means of the first and second sets of grippers.

14. The machine according to claim 13, wherein the two sets of grippers of identical structure are synchronized being mechanically connected to the ends of a rotary handling arm movable in the heightwise direction.

15. The machine according to claim 13, wherein the two sets of grippers are independent being mounted on two different rotary handling arms movable in translation and in rotation.

16. The machine according to claim 9, wherein the preparation station comprises a pair of clamping jaws situated at the end of a cover with pleats, a cutting device, and two sets of grips operating in conjunction with the pleats to position the cover at a preset height and to open it when formation of the sleeve takes place.

17. The machine according to claim 9, wherein the preparation station of a sleeve from a tubular cover without pleats comprises a sets of grips and a pair of suction boxes designed to create a negative pressure to perform opening of the sleeve.

18. The machine according to claim 9, wherein the preparation station of the sleeve comprises a rotary plate equipped with a plurality of rollers, and with a securing means of a width of film which is unwound from a storage reel.

19. The machine according to claim 9, wherein the depositing station is equipped with an additional securing system designed to oppose a possible friction effect of the bars on the film of the sleeve during the extraction phase on the load.

* * * * *